United States Patent [19]

Spitaler et al.

[11] Patent Number: 4,545,598

[45] Date of Patent: Oct. 8, 1985

[54] SAFETY SKI BINDING

[75] Inventors: Engelbert Spitaler, Wr. Neudorf; Gerhard Oberleitner, Vienna; Josef Svoboda, Schwechat; Theodor Nitschko; Wilfried Riss, both of Vienna, all of Austria

[73] Assignee: TMC Corporation, Baar, Switzerland

[21] Appl. No.: 315,671

[22] Filed: Oct. 27, 1981

[30] Foreign Application Priority Data

Oct. 31, 1980 [AT] Austria ..... 5376/80

[51] Int. Cl.[4] ..... A63C 9/084

[52] U.S. Cl. ..... 280/612; 280/628; 280/634

[58] Field of Search ..... 280/612, 611, 613, 628, 280/627, 626, 630, 631, 634, 624, 618, 620

[56] References Cited

U.S. PATENT DOCUMENTS

| | | | |
|---|---|---|---|
| 3,820,803 | 6/1974 | Frisch et al. | 280/612 |
| 3,919,563 | 11/1975 | Lautier et al. | 280/612 |
| 3,933,363 | 1/1976 | Schweizer et al. | 280/626 |
| 4,159,124 | 6/1979 | Salomon | 280/612 |
| 4,160,555 | 7/1979 | Salomon | 280/612 |
| 4,291,894 | 9/1981 | D'Antonio et al. | 280/611 |
| 4,298,213 | 11/1981 | Storandt | 280/628 |
| 4,371,188 | 2/1983 | Hull | 280/613 |

FOREIGN PATENT DOCUMENTS

| | | | |
|---|---|---|---|
| 2014935 | 1/1971 | Fed. Rep. of Germany | 280/620 |
| 2146453 | 3/1973 | Fed. Rep. of Germany | 280/612 |
| 2533337 | 2/1974 | Fed. Rep. of Germany | 280/618 |
| 2634649 | 2/1978 | Fed. Rep. of Germany | 280/634 |
| 2418657 | 3/1979 | France | 280/624 |

OTHER PUBLICATIONS

"Computers in Your Skiing Future" *Engineering Progress*, vol. 5, No. 1, Spring 1979.

*Primary Examiner*—David M. Mitchell

*Attorney, Agent, or Firm*—Flynn, Thiel, Boutell & Tanis

[57] ABSTRACT

A safety ski binding includes a releasable jaw having a pivotally supported holding mechanism which is adapted to engage a ski shoe. The jaw includes first and second cylinders with fluid actuated pistons therein, and a fluid channel interconnects the cylinders. A check valve in the fluid channel resists fluid flow from the first cylinder to the second, and a solenoid controlled valve in the fluid channel, when open, creates a bypass around the check valve. A mechanism is provided for applying forces to the piston of the second cylinder to pressurize the first cylinder via the check valve causing the piston of the first cylinder to itself be urged against or to urge another member against a locking track in a manner which maintains the jaw in a closed position. In a preferred embodiment, the cylinders are provided on the holding mechanism and the locking track is fixed to the ski. Sensors responsive to forces exerted on the holding mechanism by the ski shoe drive a control unit which, when the forces exceed a predetermined threshold, actuates the solenoid controlled valve to release the jaw.

9 Claims, 20 Drawing Figures

SAFETY SKI BINDING

FIELD OF THE INVENTION

This invention relates to a safety ski binding having a jaw which can be released voluntarily or, upon reaching dangerous load conditions, automatically, including a holding mechanism for a ski shoe which can be held in its holding position by means of a first cylinder-piston arrangement which forms with a further cylinder-piston arrangement a closed hydraulic system and can be pressurized by fluid from the latter through a check valve, wherein the check valve can be bridged by means of a solenoid controlled valve controlled by a control unit which processes signals produced by force sensing means.

BACKGROUND OF THE INVENTION

In the magazine "Engineering Progress", Volume 5, No. 1, issued by the University of California at Davis, there is described a binding system for laboratory tests in which a ski shoe is held by means of holding mechanisms operated by cylinder-piston arrangements. A first cylinder-piston arrangement is connected to a further cylinder-piston arrangement through a check valve which prevents a discharge of the pressure fluid from the first cylinder-piston arrangement and a solenoid operated valve which is controlled by a control circuit which processes signals produced by force sensing means. The further cylinder-piston arrangement can be operated by one manipulation and forms with the first cylinder-piston unit a closed hydraulic system. A dynamometer arranged between the ski shoe sole and the ski is connected to an external control unit which produces a release signal when a certain level input is produced by the force sensing means, which release signal causes the solenoid controlled valve to open so that forces acting onto the holding mechanism will effect a discharge of fluid from the first cylinder-piston arrangement, thus facilitating a release of the holding mechanism.

Starting out from this device developed for laboratory testing, the goal of the invention is to provide a binding having such a jaw which can be mounted entirely on a ski and which, with minimum cost, operates in an acceptable and sufficient manner.

SUMMARY OF THE INVENTION

This is attained inventively by providing a binding having a jaw of the foregoing type in which the holding mechanism is pivotal about at least one axis and preferably about two perpendicular axes, and in which a locking track is provided which is engaged, possibly through an intermediate member, by the piston of the first cylinder-piston arrangement which can be filled through the preferably manually operable check valve from the further cylinder-piston arrangement and can be emptied through the solenoid controlled valve.

In this manner, it is possible to provide a safety ski binding with holding mechanisms which directly engage the ski shoe, including the releasable jaw which is provided with the cylinder-piston arrangements and has a holding mechanism which is pivotal about two axes positioned normal to one another, and including a further jaw which has a substantially rigid holding mechanism which is preferably supported on a flexible rod which is held on the ski and has, at least on its approximately vertically extending side surfaces, resistance strain sensors which are connected through electric wires to the control unit for the releasable jaw. A further possibility consists in the substantially rigid holding mechanism being held on an arm which is supported pivotally on a ski-fixed vertical pin and is connected by a force sensing means, for example a piezoelectrical element, to a stop member which is spaced from the pin, the force sensing means being connected through electric wires to the control unit for the releasable jaw. To achieve increased lateral elasticity of the binding, it is also possible to provide, in addition to the releasable jaw which is provided with the cylinder-piston arrangement and has a holding mechanism which is pivotal about two axes which are normal to one another, a further jaw, the holding mechanism of which can be pivoted slightly about a vertical axis against the force of a spring system.

By mounting the force sensing means on one or on both holding mechanisms, an increase in the base of the shoe, as is the case for the dynamometer arranged between the ski and shoe sole in the described laboratory apparatus, is avoided, and by providing a locking track, it is possible to achieve a centering effect in order to make the return of the holding mechanism into the normal position easier after an automatic release caused by dangerously high forces.

In a preferred embodiment of the invention, it is provided that the piston of the cylinder-piston arrangement which can be emptied through the check valve can be pressed by means of a lever hinged to the releasable holding mechanism into a position which corresponds with and effects the pressurized condition of the holding mechanism. This makes it possible, in the case of a release, that practically immediately after the opening of the check valve the holding force of the holding mechanism goes substantially to zero and therefore the shoe is very quickly released. A particularly simple construction is obtained if the two cylinder-piston arrangements are positioned normal to one another, the further cylinder-piston arrangement which can be emptied through the check valve being arranged above the first cylinder-piston arrangement and oriented substantially vertically. In this case, it is possible for the piston of the further cylinder-piston arrangement to be operated by a lever which is arranged on the upper side of the jaw and can be pressed down conveniently with a ski pole.

According to a further characteristic of the invention, it is provided that force sensing means, for example resistance strain sensors for detecting the horizontally and vertically acting forces, are arranged on a ski-fixed, substantially L-shaped support member which carries the locking track that is engaged directly or indirectly by the piston of the first cylinder-piston arrangement, and that the support member has on a leg which extends vertically of the ski a nose with a considerable expanse transversely of the ski, under which nose, when the jaw is in its closed position, grips a locking element which has, in the transverse direction of the ski, a considerable expanse, is biased by the first cylinder-piston arrangement and is supported on the pivotally supported holding mechanism of the jaw.

This measure assures that, both in the case of a torsion stress and also in the case of a force occurring in a vertical direction on the shoe, a change of the forces which act onto the force sensing means results, the force sensing means being arranged on a leg of the support member which extends parallel to the ski and being connected by electric wires to the control unit, which is advantageously arranged in the ski. With this, it is possible to make do with short wires which extend only within the releasable jaw and are therefore protected against damage.

To determine the forces which act substantially vertically onto the shoe which is held in the binding, it can also be provided that the down-holding means of the holding mechanism which engages the upper side of the sole of a ski shoe is constructed as a flexible rod and is provided with force sensing means, for example a resistance strain sensor.

To achieve a small elasticity of the holding mechanism for large forces which still lie below dangerous values, in a preferred embodiment of the invention it is provided that between the working surface of the piston of the first cylinder-piston unit and the locking track on the support member, an elastic element is interpositioned.

If, however, experienced skiers desire an exact guiding of the ski under extreme conditions, then it is advantageous if the locking track has a locking recess engaged by a piston of the first cylinder-piston arrangement made of rigid material, which piston is provided with a tip or a rib. With this, a relatively rigid connection of the ski to the shoe is assured until dangerous load conditions are reached and produce a sudden release of the jaw, permitting an exact guiding of the ski until this point in time.

In order to assure for a properly attached binding a holding force by the holding mechanism which, aside from negligible temperature influences, is always the same, it can be provided that the cylinder-piston unit which can be emptied through the check valve is controlled through a control cam or control curve. With this, the pressure which builds up in the first cylinder-piston arrangement is determined by the path of the control cam. Thus, when the binding is attached, differences in the holding force due to errors during attaching are avoided.

One exemplary embodiment of such a jaw is distinguished by the first cylinder-piston arrangement and the further cylinder-piston arrangement which can be emptied through the check valve being arranged preferably coaxially to one another in the holding mechanism which is pivotal about at least one axis, and by both the front portion of the control cam which cooperates with the further cylinder-piston arrangement and also the locking track, which has if desired a locking recess, being arranged skifixed. With this, it is possible to arrange the locking track and the control cam for example on a ski-fixed frame, which results in a very compact structure of the jaw.

In a further very advantageous exemplary embodiment of a jaw with a cylinder-piston arrangement which is controlled by a control cam, it is provided that the first cylinder-piston arrangement and the further cylinder-piston arrangement are arranged in a ski-fixed assembly and the locking track and the control cam are arranged on the holding mechanism which is pivotal about at least one axis, which results in a very simple design. To make possible in this embodiment a pivoting of the holding mechanism about two axes which are normal to one another, it is advantageous if the cylinder-piston arrangements are arranged generally parallel to one another and lie one above the other and if the locking track which is associated with the first cylinder-piston arrangement is arranged above the control cam and above the plane which goes through a horizontally extending axis of the holding mechanism and extends parallel to the standing plane of the jaw, and is curved concavely in a plane which extends parallel with respect to the standing plane, in contrast to which, however, the control cam is curved convexly.

To clearly determine the closing point of the releasable jaw, it is advantageous, in the embodiments which are provided with a cylinder-piston arrangement which is controlled by a control cam, if at least one locking point which corresponds with the closed position of the holding mechanism is provided in the locking track or the control cam and if, between one of the pistons and the associated part which rests on the locking track or the control cam, there is arranged an element which can be compressed elastically. It is advantageously provided in this connection that the distance in an axial direction between the bottom of the cylinder of the further cyinder-piston arrangement and the control cam increases more quickly with an increasing angle of deflection from the closed position of the holding mechanism than the distance in an axial direction between the bottom of the first cylinder-piston arrangement and the locking track decreases. With this, on the one hand, the compression of the volume of the completely closed hydraulic system which is needed to leave the locked position is possible and, at the same time, it is assured that, after leaving the locked position, the holding force applied by the first cylinder-piston arrangement is practically zero.

The elastically compressible element is preferably an elastic element which is inserted between two axially spaced parts of a piston of one of the cylinder-piston arrangements, so that the piston can be shortened somewhat by forces acting along its axial length.

Of course, it would also be possible to support a piston on a pressure spring which, in turn, is supported on the locking track.

If, in the case of those cylinder-piston arrangements which can be emptied through the check valve and are controlled by a control cam, there is a desire for a practically nonelastic holding of the ski shoe until the release condition is reached in order to permit an exact guiding of the ski, even under extreme conditions, it is provided according to a further characteristic of the invention that the movable member of the solenoid controlled valve can be moved into and can be pulled out of the area of the intersection of the channels which lead to the respective cylinder-piston arrangements. Thus, sufficient operation can be found with only slightly deformable elastic members positioned between the support points of the piston on the control cam and the locking track, since removal of the movable member of the valve when the valve is actuated causes the volume of the hydraulic system, which depends on the positions of the working surfaces of the pistons, to be increased, whereby the pressure in the system is reduced. The elastic members can be replaced by a slight bendingelastic arrangement, or dimensioning of the elements which support the control cam, the locking track, or the pistoncylinder arrangement need only be done so as to allow for unavoidable manufacturing tolerances. The reduction in the volume of the hydraulic system, which occurs during crossing of the edges of the locking positions can be more than balanced by a suitable dimensioning of the movable member of the solenoid controlled valve.

BRIEF DESCRIPTION OF THE DRAWINGS

The invention will now be described in connection with the drawings, in which.

DETAILED DESCRIPTION

Figure 1:
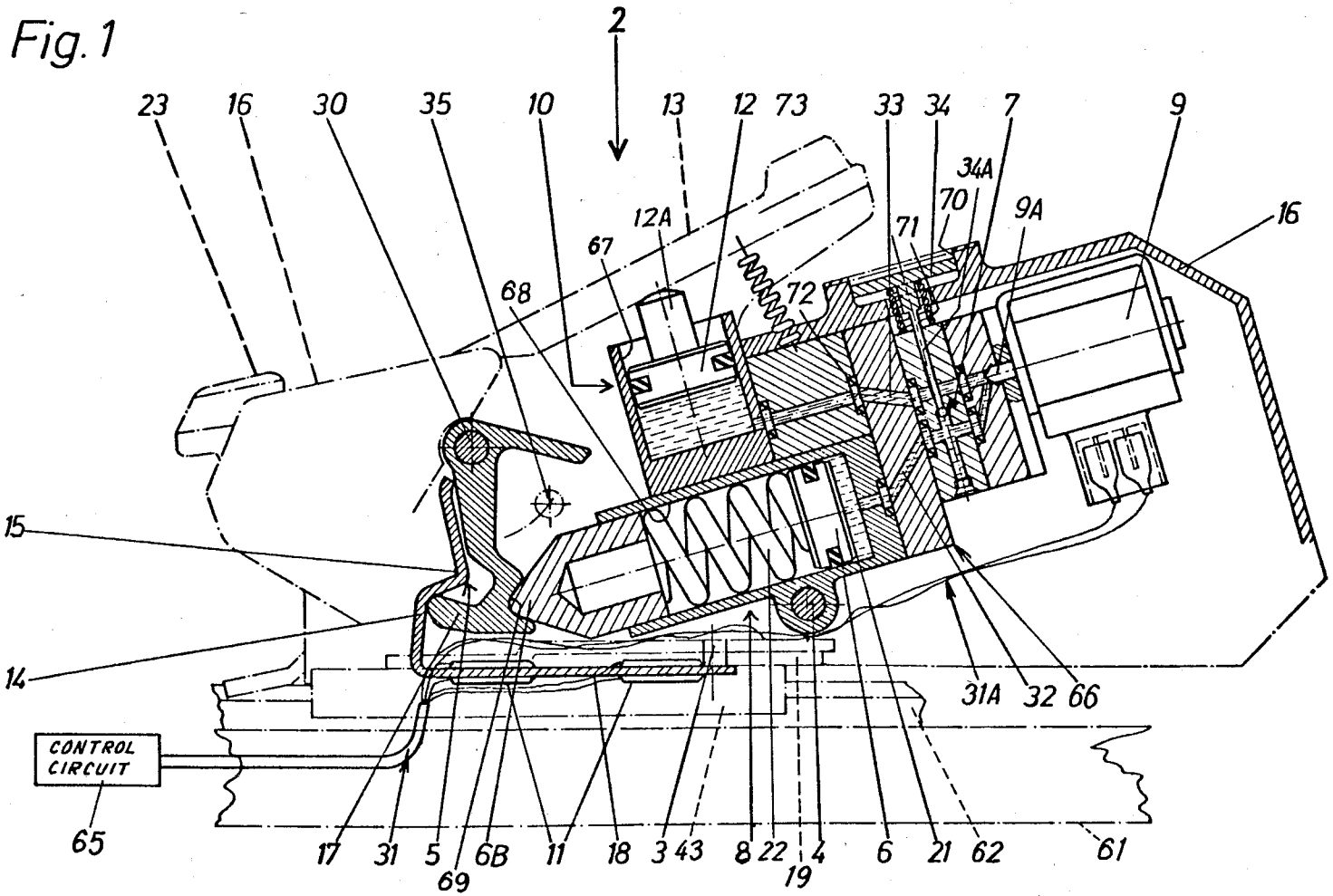
FIG. 1 is a sectional side view of a releasable jaw embodying the present invention.

In the embodiment according to FIG. 1, a releasable jaw 2 of a ski binding has a holding mechanism 16 which is pivotal about two axles 3 and 4 positioned normal to one another and is provided with a downholding means 23 for gripping the sole of a not illustrated ski shoe.

The binding includes a rail 62 secured on the upper surface of a ski 61 and a base plate 43 which is slidably supported on the rail 62 and can be releasably secured to the rail 62 at selected locations therealong. The rail 62 and base plate 43 are conventional and therefore not described in detail. The axle 3 is vertical and is mounted on the top of the base plate 43, and a housing part 19 which rests on the upper side of the base plate 43 is pivotal about the axle 3.

The axle 4 is horizontal and supported by the housing part 19 of the jaw 2, which housing part 19 is pivotal about the ski-fixed axle 3, and the holding mechanism 16 is supported on and pivotal about the axle 4. The holding mechanism 16 is provided with a locking element or member 17 which is pivotal about an axle 30 arranged on the holding mechanism 16 and has and end which engages an offset portion or nose 15 on a locking track or surface 5 in the closed position of the jaw 2. The locking track 5 is provided on a substantially vertical leg of a substantially L-shaped member 14, the other leg 18 of the member 14 extending substantially parallel to the plane of the ski surface and being fixed to the base plate 43 in the area of its free end.

The holding mechanism 16 includes a central assembly 66 having two fluid actuated piston and cylinder arrangements 10 and 8 which respectively include cylindrical recesses 67 and 68 in the central assembly 66, the recess 67 facing generally upwardly and the recess 68 being approximately normal to the recess 67 and facing the lower end of the locking element 17. A piston part 6A and a piston 12 are respectively disposed in the recesses 68 and 67, and a conventional annular seal encircles each and slidingly engages the walls of the associated recess 67 or 68. The piston 12 has an upright stem 12A thereon. A piston part 6B is also slidingly disposed in the recess 68 and is axially spaced from piston part 6A, and a helical spring 22 is disposed in the recess 68 and has its respective ends engaging the piston parts 6A and 6B. The outer end of piston part 6B is somewhat pointed and is urged by the spring 22 into engagement with a recess 69 which is provided in the locking element 17 adjacent the lower end thereof.

The central assembly 66 has fluid channels 32 and 33 which respectively communicate with the inner ends of the recesses 68 and 67. A conventional check valve 7 is provided between the channels 32 and 33 and permits fluid to flow from channel 33 to channel 32. A release member 34 is slidably disposed in a shallow recess 70 in the central assembly 66 and has a stem 34A which extends through a bore in the central assembly 66 and engages the check valve 7. A helical spring 71 urges the release member 34 upwardly. When the release member 34 is pressed downwardly against the force of the spring 71, the stem 34A forces the check valve 7 to an open position in which fluid can freely flow between the channels 32 and 33 in either direction.

The channels 32 and 33 intersect near the rear end of the central assembly 66. A conventional solenoid 9 is mounted on the rear end of the central assembly 66 in a conventional manner and has a movable rod 9A which extends slidably into a bore provided in the central assembly 66 and communicating with the channels 32 and 33 at the intersection thereof. When the solenoid 9A is not energized, the rod 9A is urged leftwardly in FIG. 1 by a not illustrated spring in the solenoid to a position in which its free end is completely obstructing fluid flow between the channels 32 and 33, as illustrated in FIG. 1. When the solenoid is energized by electrical current supplied through wires 31A by a control unit 65, the rod 9A moves rightwardly against the force of the not illustrated solenoid spring a sufficient distance to permit free flow of fluid between the channels 32 and 33. The rod 9A, in effect, is a valve controlled by the solenoid 9.

In the preferred embodiment, the central assembly 66 is made from a number of separate components, and a conventional annular seal element 72 is provided between the components at each location where the channels 32 and 33 pass from one component into an adjacent component, in order to prevent leakage of fluid.

Both the locking element 17 and also the leg of the member 14 which carries the locking track 5 have a considerable expanse in a direction transversely of the ski, so that a force which acts transversely to the axis 3 onto the holding mechanism 16 causes a tractive or pulling force to act onto the leg 18 of the member 14 which extends parallel to the plane of the ski. A tractive force also acts onto the leg 18 of the member 14 when an upwardly directed force is applied to the down-holding means 23, due to the related small upward movement of the locking element 17 which engages the nose 15 of the locking track 5. These forces are converted into electrical signals by conventional resistance strain sensors 11 which are arranged on the leg 18 of the member 14, connected to a control circuit 65 arranged on the ski by wires 31, and responsive to bending or pulling forces. The circuit 65, which is described in greater detail hereinafter, evaluates the signals according to predetermined criteria and, if necessary, emits a signal on wires 31A to energize the solenoid 9 and open the valve 9A. The solenoid 9, when actuated, opens the valve 9A located between the channels 33 and 32 which respectively communicate with the cylinder-piston arrangement 10 and the cylinder-piston arrangement 8. A further fluid connection between the channels 33 and 32 is possible through the check valve 7 which, in the illustrated embodiment, can be manually opened by a spring-loaded release member 34. A flow of fluid from the cylinder-piston arrangement 8 to the cylinder-piston arrangement 10 is possible only when the check valve 7 is manually opened or the solenoid 9 is energized.

In order to bring the jaw 2 into its closed position, a lever 13 which is pivotally supported on the axle 30 is pressed down into engagement with the stem 12A of the cylinder-piston arrangement 10 against the force of a helical spring 73, forcing the piston 12 down into the recess 67 and forcing the pressure fluid therein, when the magnetic valve 9 is not energized, to flow into the channel 33, through the check valve 7, into the channel 32, and then into the cylinder-piston arrangement 8 where it acts on the working surface 21 of the piston 6A and urges the piston 6A outwardly. With this, the spring 22 provided in the recess 68 of the cylinder-piston arrangement 8 and supported on the piston part 6B is compressed, and a force sufficient to lock the jaw 2 is applied onto the locking element 17 which in turn engages the locking track 5.

Forces which act onto the jaw 2 are detected by the resistance strain sensors 11, and the resulting electrical signals are evaluated in the control circuit 65. If dangerous loads occur, namely, if high forces accumulate for a dangerously long time, the solenoid 9 will be energized and open the valve 9A, and the fluid which is provided in the cylinder-piston arrangement 8 will be removed from the piston 6 under the influence of the spring 22, flowing through the opened valve 9A to the cylinder-piston arrangement 10. The spring 22 will thereby relax somewhat and the holding force which acts onto the locking track 5 through the piston part 6B will quickly be reduced, so that the forces acting onto the holding mechanism 16 will swivel it or tilt it upwardly, effecting a release of the ski shoe from the jaw 2.

A voluntary release of the jaw 2 is possible by pressing the release member 34 to open the check valve 7 and simultaneously pulling upwardly on the holding mechanism 16, so that fluid is discharged from the cylinder-piston arrangement 8 to the cylinder-piston arrangement 10 through the channels 32 and 33 and the open check valve 7.

Figure 2:
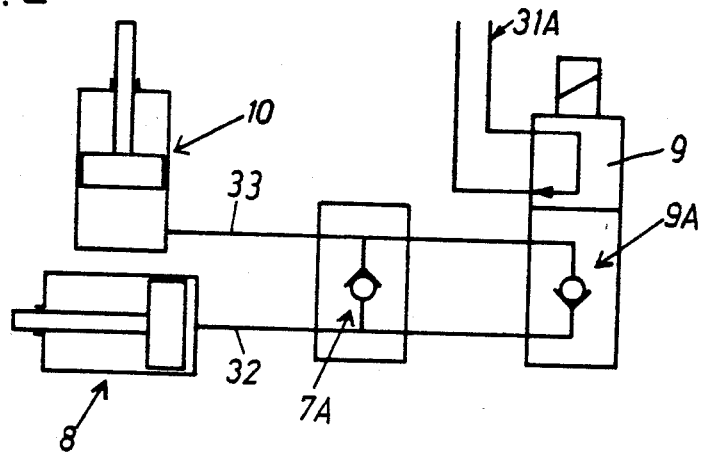
FIG. 2 is a schematic diagram of the hydraulic system of an alternative embodiment of the jaw of FIG. 1.
Figure 3:
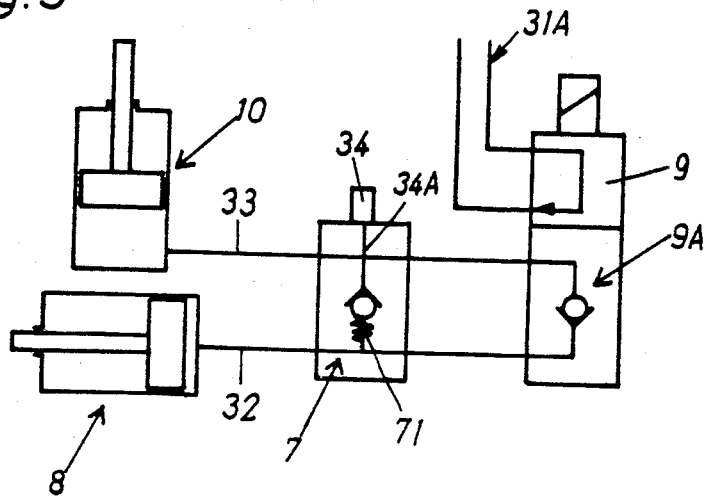
FIG. 3 is a schematic diagram of the hydraulic system of the jaw of FIG. 1.

A hydraulic schematic for the jaw 2 of FIG. 1 is illustrated in FIG. 3, and FIG. 2 illustrates a hydraulic schematic for a jaw which is a slightly modified version of the jaw 2 of FIG. 1. Namely, in the case of this modified jaw, and with an otherwise identical design, in place of a manually operable check valve 7 a common check valve 7A which is not manually operable is provided, and a voluntary release of this jaw can occur only by manually or electrically actuating the solenoid controlled valve 9A.

Considerable elasticity during use of the jaw 2 is provided by the spring 22 which is arranged between the piston part 6A which is loaded by the pressure fluid and the piston part 6B, but as a result the ability to exactly guide the ski under extreme conditions during which correspondingly high forces occur is worse, due to movement of the jaw which is possible because of the elasticity.

In applications where less elasticity is desired, the spring 22 and piston part 6B can be omitted and the piston 6A can be provided on its back side with a point which presses directly against the locking element 17 or with a rib which extends transversely with respect to the longitudinal direction of the ski and presses either against the locking element 17 or, if the locking element 17 is omitted, directly against the locking track 5. In this case, the jaw remains in its locked position until the solenoid controlled valve 9A is energized by a release signal from the control circuit 65 caused by a dangerously high load, or until the check valve 7 is manually opened and the fluid in the cylinder-piston arrangement 8 is discharged to the cylinder-piston arrangement 10.

Figure 4:
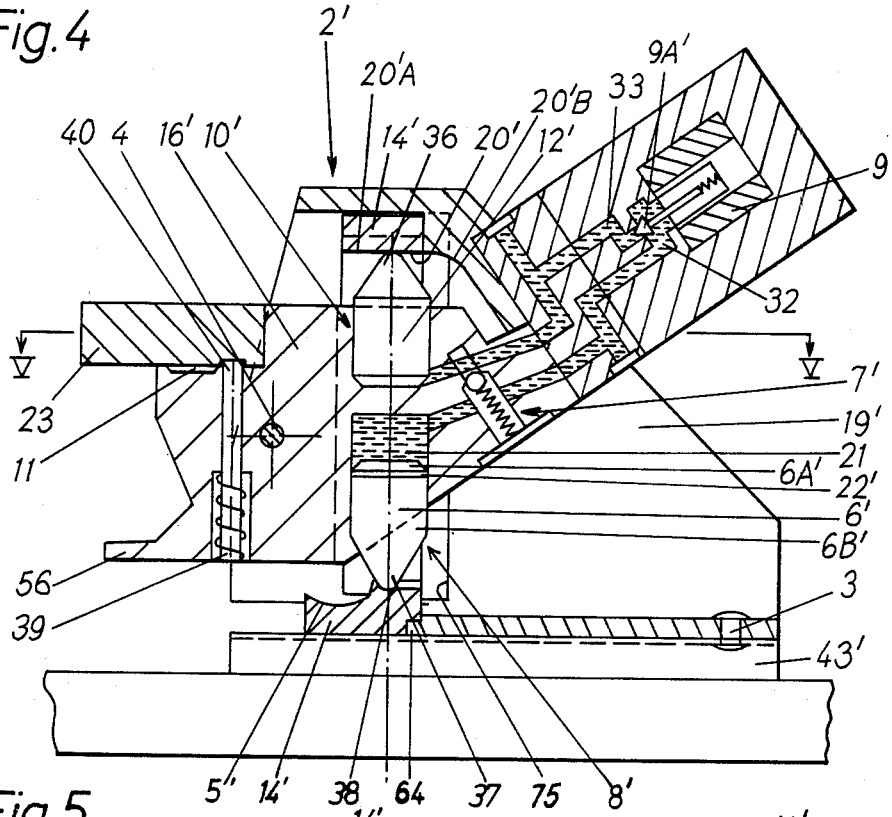
FIG. 4 is a sectional side view of a second alternative embodiment of the jaw of FIG. 1.
Figure 5:
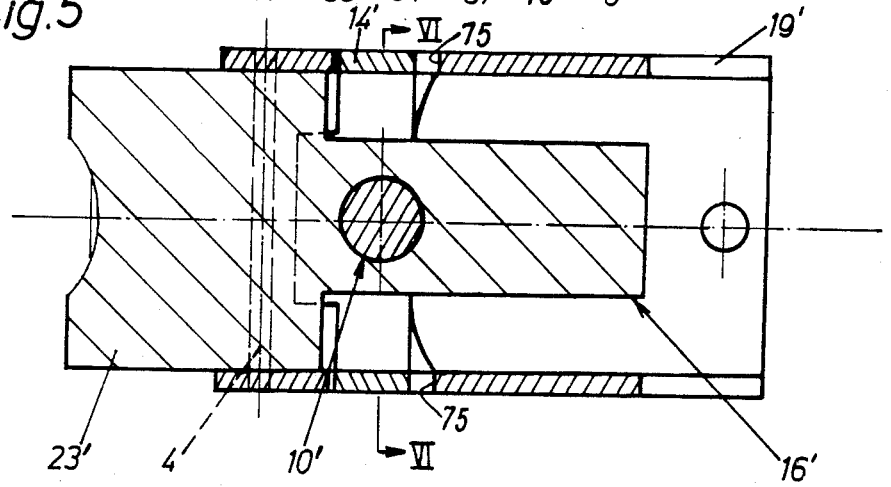
FIG. 5 is a fragmentary sectional view taken along the line V—V of FIG. 4.
Figure 6:
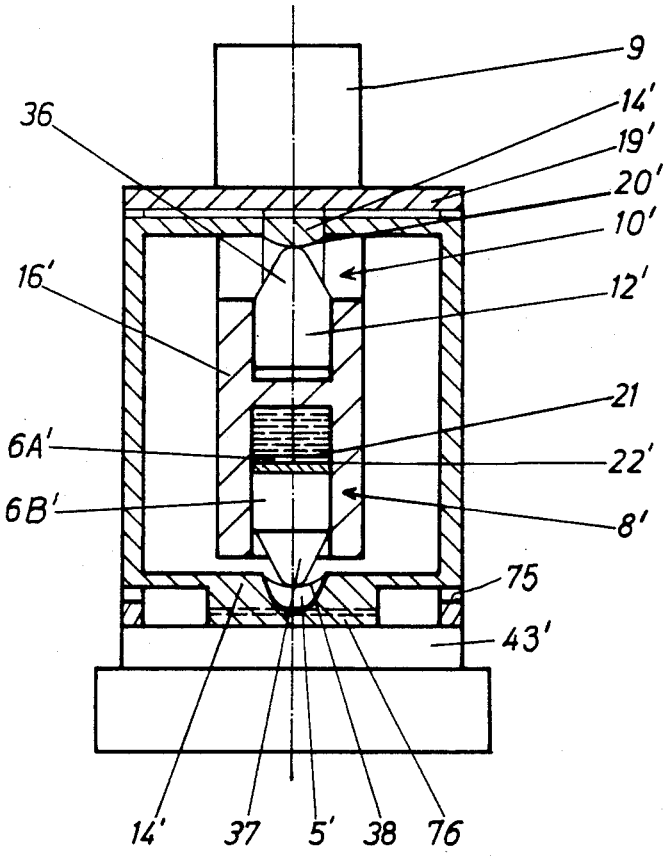
FIG. 6 is a sectional view taken along the line VI—VI of FIG. 5.

In the embodiment of a releasable jaw 2' according to FIGS. 4–6, the holding mechanism 16' is also pivotal about two axles 3 and 4 which are positioned normal to one another. The cylinder-piston arrangement 10', the cylinder-piston arrangement 8', the check valve 7' and the solenoid controlled valve 9A' are each, as in the embodiment according to FIG. 1, arranged in the holding mechanism 16' or connected rigidly to it. However, operation of the cylinder-piston arrangement 10' does not occur in this embodiment by means of a lever, but rather by means of a control cam 20, the front portion 20'A of which is provided on a ski-fixed, framelike abutment support member 14', and the rear portion 20'B of which is provided on the underside of the top of the housing part 19'. On the support member 14' is also provided the locking track 5'. This framelike support 14' also serves as a lock against tilting for the housing part 19' which is rotatable about the axle 3 and supports the axle 4. The front edge of the bottom portion of the housing part 19' is disposed under a shoulder 64 on the support 14'.

In other words, the housing part 19' rests on a base plate 43' and is pivotal about the axle 3 supported vertically in the base plate 43'. The housing part 19' supports the horizontal axle 4', on which the holding mechanism 16' is pivotally supported, and has rectangular openings 75 in each side wall thereof.

The support 14 is generally rectangular, as shown in FIG. 6, and is rigidly secured to the base plate 43' by a base portion 76 at the lower end thereof. When the housing part 19' pivots about the axle 3, one side of the support 14' will project outwardly through the associated opening 75 in the housing part 19'.

As can be seen from FIG. 5, the front edge of the bottom portion of the housing part 19' is rounded to permit swiveling movement of the part 19' about the axle 3. From FIGS. 4 to 6, it can be seen that the locking track 5' has a locking recess 38 which can receive the tip 37 of piston 6' and determines the locked position of the holding mechanism 16' corresponding to the closed position of the jaw 2'. The control cam 20 provided on the top side of the support 14' has, in the area engaged by the tip 36 of the piston 12' in the locked position, a convex shape (FIG. 6).

The operating principle of the jaw 2' corresponds generally to the principle of the jaw 2 illustrated in FIG. 1. The removal of the liquid from the cylinderpiston arrangement 10 by piston 12' occurs during rotation of the holding mechanism 16' about the axle 4 caused by downward forces exerted on its stepping spur 56. The tip 36 of the piston 12' is thereby caused to slide along the three-dimensional control cam 20' and, due to the rotational movement of the mechanism 16' about the axle 4, the distance between the control cam 20' and the inner end of the cylinder of the cylinderpiston arrangement 10', measured in its axial direction, is reduced more quickly than the distance between the locking track 5' and the bottom of the cylinder of the holding-cylinder-piston arrangement 8' is enlarged. This results, due to the incompressibility of the fluid, in a jamming of the tip 37 of the piston 6' into the locking recess 38 of the locking track 5' and thus in a locking of the holding mechanism 16' in the closed position. The pressure build-up for locking of the jaw 2' thus occurs during the stepping in.

In order to insure that the tip 37 of piston 6' can overcome the edge of the locking recess 38 to facilitate a release, the piston 6' is divided into two parts 6A' and 6B' and an elastically compressible insert 22' is inserted between the two parts 6A' and 6B' and is connected thereto, for example by gluing.

If dangerous loads occur, the solenoid 9 controling the valve 9A' is, as already mentioned, energized by the not illustrated control unit and opens the valve 9A' to provide a fluid connection between the channels 32 and 33, so that the fluid can flow from the cylinder-piston arrangement 8' into the cylinder-piston arrangement 10' in spite of the check valve 7', as a result of which the jamming of the piston 6 into the locking recess 38 is cancelled. In the case of forces which engage the down-holding means 23 and are directed upwardly, a greater compression of the insert 22' of the piston 6' can possibly occur as the piston tip 37 crosses over the edge of the locking recess 38, if the volume of the pin of the solenoid controlled valve 9 which effects the blocking of the connection between the channels 32 and 33 and during energization is pulled back is not sufficiently large to compensate for the volume reduction in the hydraulic system caused when crossing over the edge of the locking recess 38. Thereafter, a quick pressure reduction will result in the hydraulic system in which no gas cushion for the initial tension at all is provided, so that the holding force of the holding mechanism 16' after a deflection thereof of a few angle degrees from the closed position becomes practically zero.

In the case of forces which act laterally onto the jaw 2' or its holding mechanism 16' and cause energization of the solenoid controlled valve 9A', the holding force also becomes practically zero after a lateral deflection of a few degrees, since the radius of curvature of the control cam 20' is smaller in a vertical plane which is transverse to the ski than the radius of the recess 38 in the track 5', so that the distance between the points on these surfaces engaged by the pistons 6' and 12' effectively increases during a lateral deflection of the holding mechanism 16', and thus the volume of the hydraulic system, which is controlled by engagement of the surfaces 5' and 20' by the pistons 12' and 6', also becomes larger.

As can be seen from FIG. 4, the down-holding means 23' is, in this exemplary embodiment, constructed as a flexible bar and is provided with a resistance strain sensor 11 which is connected by not illustrated electric wires to the also not illustrated control circuit. The down-holding means 23' is connected to the remaining part of the holding mechanism 16' by a pin 40 thereon which is disposed in a bore in the holding mechanism 16' and is urged downwardly by a spring 39, whereby a certain limited amount of elasticity is achieved.

Figure 7:
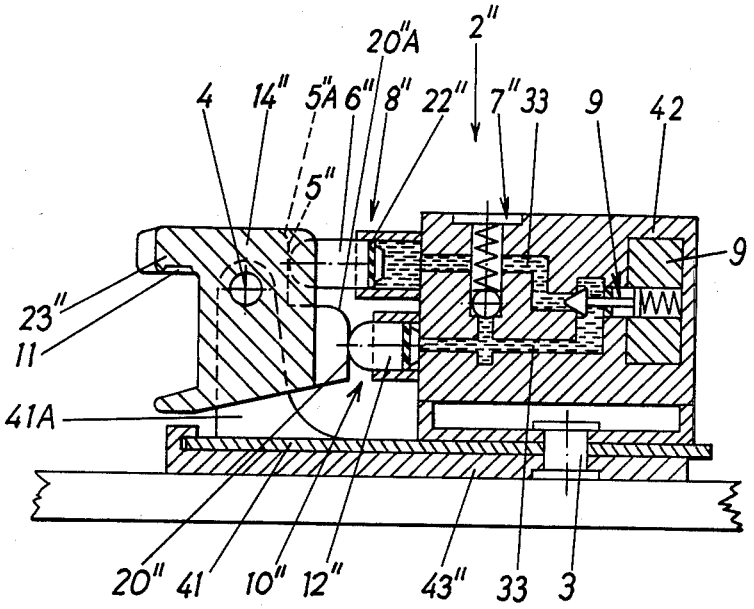
FIG. 7 is a sectional side view of a third alternative embodiment of the jaw of FIG. 1.
Figure 8:
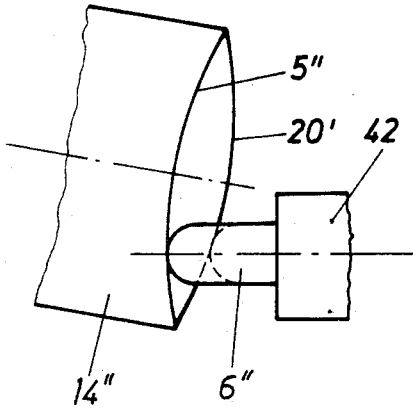
FIG. 8 is a top view of part of the jaw of FIG. 7.
Figure 9:
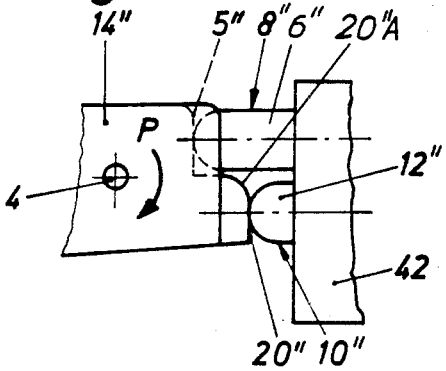
FIG. 9 is a side view of the structure illustrated in FIG. 7.

FIGS. 7–9 illustrate a further exemplary embodiment of a jaw 2'', in which the cylinder-piston arrangement 10'' also cooperates with a control cam 20'', through which the piston 12'' during the approach to the closed position of the jaw is forced inwardly. The operating principle of this jaw also corresponds generally with the principle of the jaw 2 illustrated in FIG. 1.

The holding mechanism 16'' includes a swivel plate 41 which is provided with bearing arms 41A for supporting the axle 4 and is pivotal about the ski-fixed axle 3. An abutment support member 14'' which is integral with the down-holding means 23'' is pivotally supported on the axle 4. The cylinder-piston arrangement 10'' and the cylinder-piston arrangement 8'' are, together with the check valve 7'', the solenoid 9 and the valve 9A'', provided on or in an assembly 42. The assembly 42 is rigidly connected to the axle 3 and the axle 3 is fixedly secured to the base plate 43'', whereby the assembly 42 is held nonrotatable with respect to the ski.

The member 14'' has thereon, aside from the locking track 5'' which has a concave curvature in a plane which is parallel to the top of the ski or to the base plate 43'', a control cam 20'' which is arranged below the locking track 5'' and has a convex curvature, as can be seen from FIG. 8, which illustrates schematically a position of the jaw 2'' in which the holding mechanism 16'' is deflected in a horizontal direction.

From FIG. 9, it can be seen that the curvature of the portion 5A'' of the locking track 5'' and the portion 20A'' of the control cam 20'', which curvatures become effective during an upward swinging of the downholding means 23, are different, whereby it is assured that, during swiveling of the member 14'' in the direction of the arrow P, through a small angle, the distance between the control cam 20'' and the assembly 42 in a vertical plane containing the longitudinal axis of the ski increases more quickly than the distance between the locking track 5'' and the mounting 42 decreases. This is also true during a pivoting of the holding mechanism 16'' about the axle 3. Through this, it is achieved that, when the solenoid controlled valve 9A'' is opened to effect a fluid connection between the cylinder-piston arrangement 10'' and the cylinder-piston arrangement 8'', the volume of the hydraulic system, which is controlled by engagement of the pistons 6'' and 12'' with the surfaces 5'' and 20'', can quickly increase so that the holding force exerted on the member 14'' is reduced quickly. This effect is substantially augmented when the moving rod 9A'' of the solenoid controlled valve is pulled out of the area of the intersection of the channels 32 and 33 and thus effects a further increase in the volume of the hydraulic system. In the case of this exemplary embodiment, the down-holding means 23'' is constructed as a slightly flexible member and is provided with resistance strain sensors 11.

Figure 10:
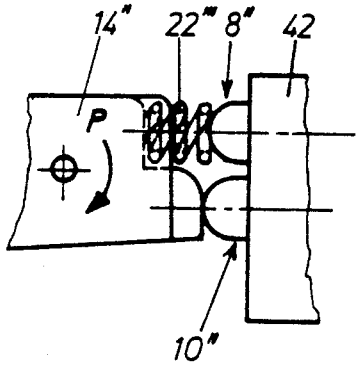
FIG. 10 is a side view similar to FIG. 9 of an alternative embodiment of the jaw of FIG. 7.

FIG. 10 illustrates a modification of the embodiment according to FIGS. 7–9 in which, to achieve a high elasticity of the jaw, the cylinder-piston arrangement 8'' acts onto the locking track 5" through a spring 22''' and thus changes the initial tension of the spring 22''' when the hydraulic pressure changes.

Figure 11:
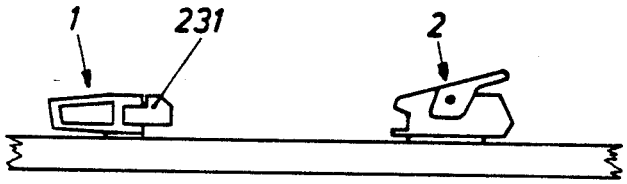
FIG. 11 is a side view of a safety ski binding incorporating a releasable jaw embodying the present invention.
Figure 11A:
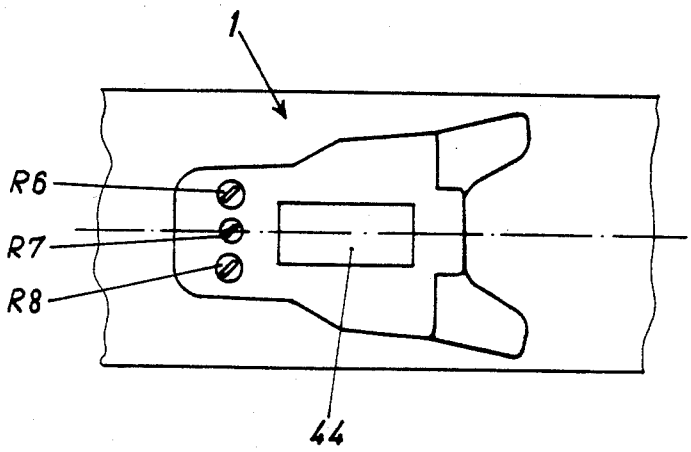
FIG. 11*a* is a top view of a non-releasable jaw which is part of the ski binding of FIG. 11.

FIG. 11 schematically illustrates a ski binding with a releasable jaw 2 such as the jaw of FIG. 1 and an initially tensioned, non-releasable jaw 1, the downholding means 231 of which is held substantially rigid. In the exemplary embodiment illustrated in FIG. 11*a*, adjusting members, for example potentiometers, R6, R7, R8, are provided on the Jaw 1 for adjusting the release setting of the binding according to data which is personal to to the user, such as weight, shoe size and tibia size. The jaw 1 is furthermore provided with a receptacle for receiving a program slide-in unit 44, each program slide-in unit, as will be discussed hereinafter, being representative of a particular ability group, like beginning, advanced and sport skiers and influencing the release characteristic accordingly. Furthermore, if desired, it is possible to arrange on the rigid jaw 1 resistance strain sensors.

Figure 12:
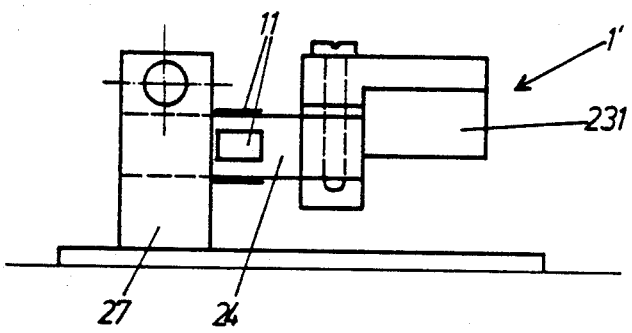
FIG. 12 is a side view of an alternative embodiment of the jaw of FIG. 11*a;*
Figure 13:
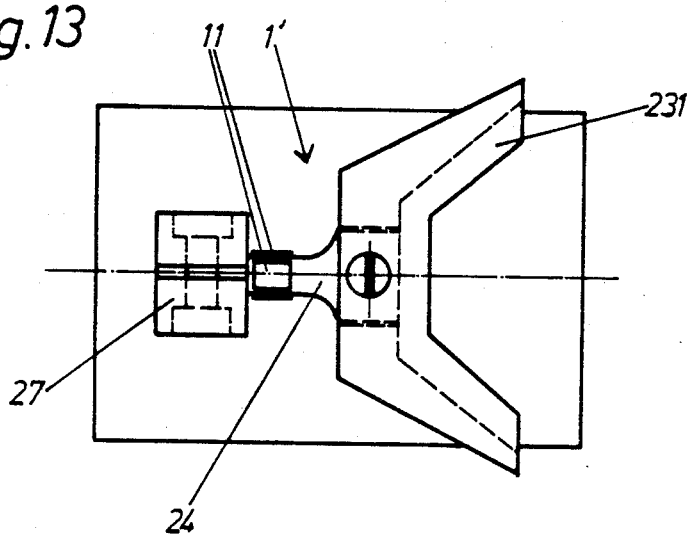
FIG. 13 is a top view of the jaw of FIG. 12.

FIGS. 12 and 13 illustrate an embodiment of a rigid jaw 1' which is particularly simply constructed and can be used in connection with a releasable jaw such as the jaws 2,2' and 2" of FIGS. 1-10. The down-holding means 231 is thereby supported adjustably in height on a slightly flexible rod 24 which is held in a ski-fixed support 27. Resistance strain sensors 11 are secured on the rod 24, which has a rectangular cross section, detect forces which act horizontally and/or vertically onto the down-holding means 231 and cause the rod 24 to flex slightly, and convert these forces into electric signals which are sent through not illustrated wires to the control unit which is preferably arranged on or in the ski.

Figure 14:
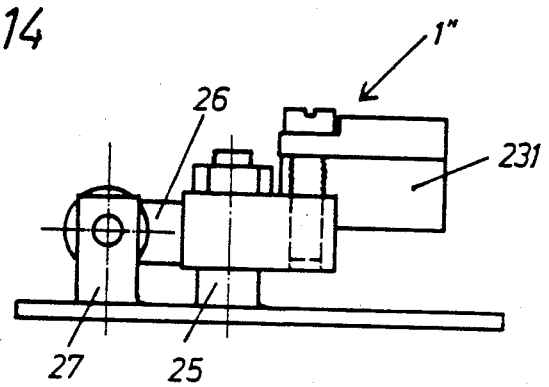
FIG. 14 is a side view of a further alternative embodiment of the jaw of FIG. 11*a;*
Figure 15:
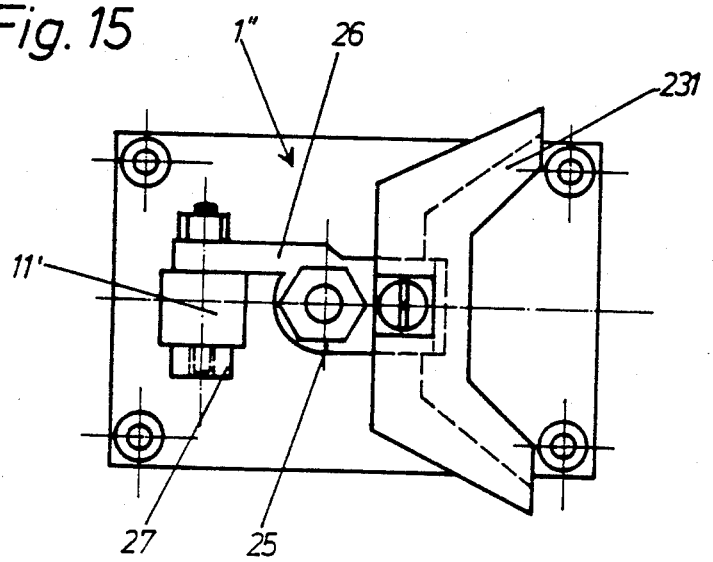
FIG. 15 is a top view of the jaw of FIG. 14.

FIGS. 14 and 15 illustrate an embodiment which is modified from the embodiment of FIGS. 12 and 13. According to the embodiment of FIGS. 14 and 15, the down-holding means 231 of the rigid jaw 1" is supported adjustably in height on an arm 26. The arm 26 is supported on and slightly pivotal about a ski-fixed vertical pin 25 and engages a force sensing element 11' which is, for example, a piezoelectric element supported on a ski-fixed member 27. The piezoelectric element is connected by not illustrated wires to a not illustrated control unit.

Figure 16:
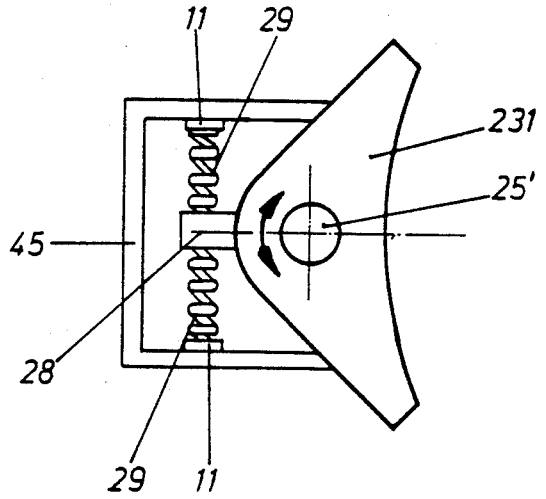
FIG. 16 is a top view of part of an alternative embodiment of the jaw of FIG. 11*a;*

FIG. 16 illustrates a modification of the last-mentioned construction in which the down-holding means 231 is supported adjustably in height and pivotally on a ski-fixed pin 25' and is provided with an extension 28. Compression springs 29 are supported against opposite sides of the extension 28, and the opposite ends of the springs 29 press against force sensing elements 11' which are arranged on the inner sides of a ski-fixed housing 45. The force sensing elements 11' are connected by not illustrated wires to a not illustrated control unit.

Figure 17:
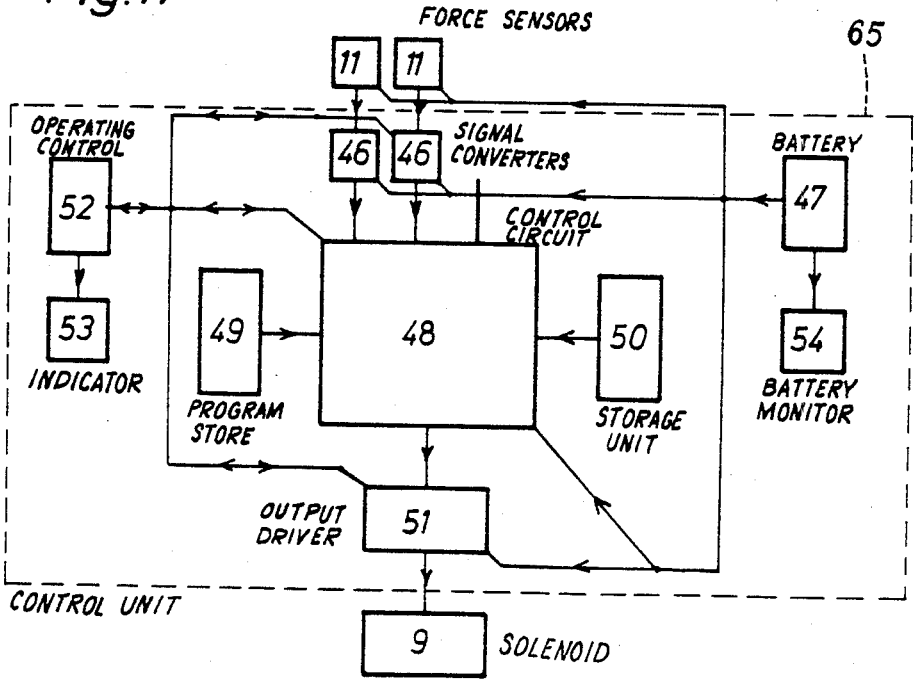
FIG. 17 is a block diagram for a control unit for controlling a releasable jaw embodying the present invention.

FIG. 17 is a block diagram of an exemplary control unit 65 for use with the inventive releasable jaws of FIGS. 1 to 16. For convenience, the description which follows describes the control unit 65 in connection with the releasable jaw 2 of FIG. 1. The force sensing elements, for example the resistance strain sensors 11 (FIG. 1), are connected to signal converters 46, which in turn are connected to the battery 47 and the central control circuit 48. The control circuit 48 is also connected to an exchangeable program store 49, a storage unit 50 for user-specific data, and an output driver 51 which drives the solenoid 9 (FIG. 1). The control unit 65 also includes an operating control mechanism 52, an indicator 53, and a battery monitor 54.

Figure 19:
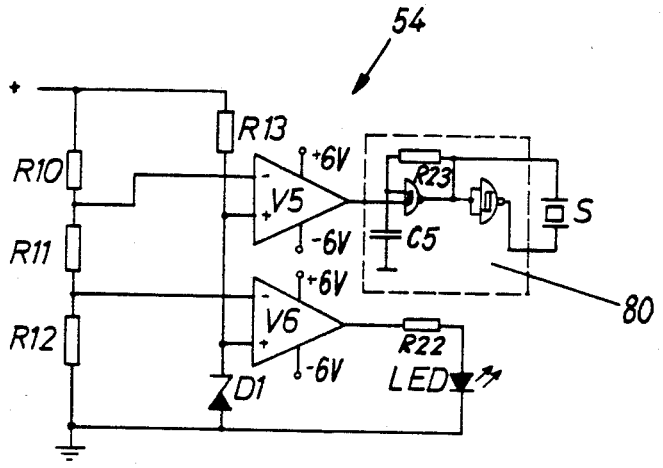
FIGS. 18 and 19 are schematic diagrams of exemplary circuits implementing different parts of the control unit of FIG. 17.
Figure 18:
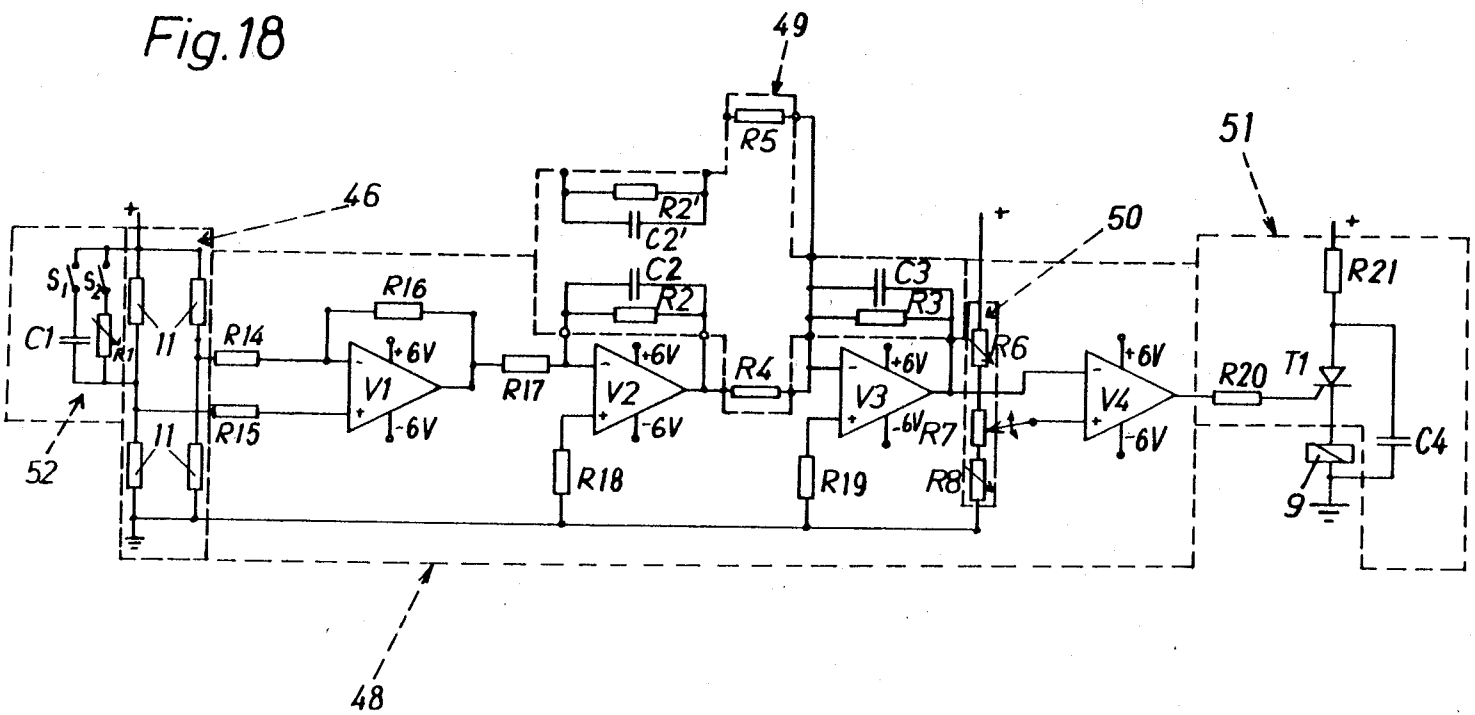

FIGS. 18 and 19 schematically illustrate an exemplary circuit for the control unit 65. Referring to FIG. 18, the operating control mechanism 52 is formed by a variable resistor R1 and a switch S2 connected in series with each other and in parallel with a capacitor C1 and switch S1, the resistor R1 and capacitor C1 influencing the signal converter 46. The switches S1 and S2 are provided for controlling the operation of the control unit 65 and should be closed by the skier one after the other before using the binding. They are open when the binding is used.

The signal converter 46 is formed by a bridge circuit of the resistance strain sensors 11, and for satisfactory operation a release will not take place when the capacitor C1 is connected to the circuit by switch S1, but will take place when the resistor R1 is connected to the circuit by switch S2. The signal entering the control circuit 48 from the signal converter 46 is amplified by the amplifier V1 and then fed to the integrator V2. The R-C network comprising resistor R2 and capacitor C2 which defines the feedback path of integrator V2, the output resistor R4 of the integrator V2 which is connected to the summing amplifier V3, the R-C feedback network comprising resistor R3 and capacitor C3 of the summing amplifier V3, and the output resistor R5 for a second, not illustrated input channel identical to that just described are provided in an exchangeable program store 49 which is selected to correspond to the ability group of the particular skier, for example a beginning or sport skier, the signal amplification and dynamic release behavior being predetermined by the particular component values selected so as to correspond to the appropriate ability group. The program store 49 could, for example, be located in the slide in unit 44 of FIG. 11*a*. The second input channel includes another resistor R2' and capacitor C2' which define the feedback path of its not illustrated integrator, and this second channel can, for example, process the signals produced by forces which act onto the second jaw, or, alternatively, one channel can process the signals produced by forces which act horizontally onto one or both jaws and the second channel can process the signals produced by the vertical forces which act onto one or both jaws. In either case, the signals from the input channels are summed up in the summing amplifier V3 and are then fed to the amplifier V4 which acts as a threshold switch, the switching threshold of which is determined by the voltage divider comprising variable resistors R6, R7 and R8, which resistors are provided in the storage unit 50 and have values corresponding to user-specific data.

The output driver 51 which is driven by the threshold switch, namely, amplifier V4, is formed substantially by a thyristor T1 which is connected to and controls the solenoid 9.

FIG. 19 illustrates an exemplary embodiment of a battery monitor 54 which includes two threshold switches formed by operational amplifiers V5 and V6, each having an input connected to a different point in a voltage divider comprising three resistors R10, R11 R12 which are connected in series across the battery. The other inputs of the amplifiers V5 and V6 receive a common reference voltage generated by the series connection of zener diode D1 and resistor R13 across the battery. A light emitting diode (LED) is connected through a resistor to the output of the operational amplifier V6 and lights up as soon as the battery output drops below a certain predetermined voltage value and causes amplifier V6 to switch state, thereby indicating the battery must be either charged or exchanged. If the battery output voltage applied at the + and − terminals drops further, then the operational amplifier V5 also changes its switching condition and causes the oscillator 80 to oscillate, driving the piezo summer S connected thereto so that it emits an audible signal to indicate that the jaw or jaws can no longer be safely used.

TABLE

The prefered value for each of the resistors and capacitors in FIGS. 18 and 19 is as follows:

| | | | | | |
|---|---|---|---|---|---|
| $R_1$ | 470 kΩ | $R_{12}$ | 390 kΩ | $R_{23}$ | 470 kΩ |
| $R_2$ | 10 MΩ | $R_{13}$ | 2,4 kΩ | $R_2'$ | 8,2 MΩ |
| $R_3$ | 68 kΩ | $R_{14}$ | 100 kΩ | $C_1$ | 5,6 nF |
| $R_4$ | 100 kΩ | $R_{15}$ | 100 kΩ | $C_2$ | 3,3 nF |
| $R_5$ | 27 kΩ | $R_{16}$ | 470 kΩ | $C_3$ | 220 pF |
| $R_6$ | 10 kΩ | $R_{17}$ | 100 kΩ | $C_4$ | 2000 μF |
| $R_7$ | 100 kΩ | $R_{18}$ | 10 kΩ | $C_5$ | 330 pF |
| $R_8$ | 10 kΩ | $R_{19}$ | 10 kΩ | $C_2'$ | 3,3 nF |
| $R_{10}$ | 150 kΩ | $R_{20}$ | 330 Ω | | |
| $R_{11}$ | 47 kΩ | $R_{21}$ | 4,7 kΩ | | |

The names and addresses of the manufacturers and the manufacturer's model numbers of the amplifiers V1 to V6, the thyristor T1, the oscillator 80, the zener diode D1, the LED and the summer are as follows:

| | model number | manufacturer |
|---|---|---|
| V1 to V6 | LM10B | Fa.National Semiconductor Corp. |
| Oszillator | CD 4093 BC | 2900 Semiconductor Drive<br>Santa Clara, California 95051 |
| $T_1$ | BRY 55/60 | Fa.Siemens AG<br>D 8000 Munchen 80<br>Balanstr.73 |
| Summer | 7 BB-20-6A | Fa.Stettner & Co<br>D 8560 Lauf a.Pegnitz<br>Hersbruckerstr.22 |
| $D_1$ | BZX55/C3V6 | Fa.AEG Telefunken<br>D 7100 Heilbronn |
| LED | MV 5152 | Fa.Monsanto Commercial<br>Products Co<br>Palo Alto, California 94304<br>3400 Hillview Ave. |

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A ski binding adapted to be mounted on a ski for releasably holding a sole of a ski boot on the ski, including a ski binding jaw which comprises: base means adapted to be mounted on the ski; a sole holder adapted to engage the sole of the ski boot and supported on said base means for movement between a downhill skiing position and a release position; means defining a locking surface on one of said base means and said sole holder; a locking member supported on the other of said base means and said sole holder for movement toward and away from said locking surface parallel to a first direction, said locking member sliding along said locking surface as said sole holder moves away from said downhill skiing position toward said release position; first cylinder-piston means Provided on said other of said base means and said sole holder and including means defining a first chamber and a first piston sealingly supported in said first chamber for reciprocal movement approximately parallel to said first direction; means provided between and operatively coupling said first piston and said locking member, including resiliently compressible means for yieldably resisting movement of said first piston toward said locking member; second cylinder-piston means which includes means defining a second chamber and a second piston sealingly supported in said second chamber for reciprocal movement therein; first and second passageway means which each provide fluid communication between said second chamber on one side of said second piston and said first chamber on a side of said first piston remote from said resiliently compressible means; check valve means provided in said first passageway means for permitting fluid flow through said first passageway means from said second chamber to said first chamber and for obstructing fluid flow therethrough from said first chamber to said second chamber; electrically actuable valve means provided in said second passageway means for permitting and obstructing fluid flow therethrough when respectively energized and de-energized; means for applying a force to said second piston in a second direction so as to urge fluid in said second chamber to flow through said first and second passageway means; sensor means for producing electrical signals in response to forces exerted on a ski boot releasably held by said binding; calculator means responsive to said sensor means and operatively coupled to said electrically actuable valve means for selectively energizing said electrically actuable valve means in response to said signals from said sensor means; and manually actuable means for selectively opening said check valve means so as to permit fluid flow through said first passageway means from said first chamber to said second chamber.

2. The binding according to claim 1, wherein said locking surface has a nose extending transversely of the ski and wherein, when said sole holder is in its downhill skiing position, an end of said locking member is disposed under said nose of said locking surface.

3. The binding according to claim 1, wherein said one of said base means and said sole holder is said base means; wherein said second cylinder-piston means, said first and second passageway means, said check valve means, and said electrically actuable valve means are all provided on said sole holder; wherein said movement of said sole holder between said downhill skiing and release positions is pivotal movement about a substantially horizontal axis; wherein said locking surface on said base means extends generally vertically and has an outwardly projecting nose; wherein said locking member is supported on said sole holder for pivotal movement about a generally horizontal axis; wherein said means provided between and operatively coupling said first piston and said locking member includes a piston part which is supported on said sole holder between said locking member and said first piston for movement toward and away from said locking member parallel to said first direction and is adapted to operatively engage said locking member; and wherein said resiliently compressible element is a helical compression spring having one end supported on said first piston and its other end supported on said piston part.

4. The binding according to claim 1, wherein said second cylinder-piston means is provided on said other of said base means and said sole holder, and wherein said means for applying a force to said second piston includes a manually actuable lever which is pivotally supported on said other of said base means and said sole holder and is operatively coupled to said second piston.

5. The binding according to claim 1, wherein said second cylinder-piston means is provided on said other of said base means and said sole holder, wherein said first and second directions are approximately perpendicular to one another, and wherein said second cylinder-piston means is arranged above said first cylinder-piston means and said second direction is approximately perpendicular to an upper side of the ski.

6. The binding according to claim 1, wherein said one of said base means and said sole holder is said base means, wherein said base means includes a substantially L-shaped bearing part, wherein said sensor means includes force detecting means for detecting horizontally and vertically acting forces, said force detecting means being provided on a leg of said bearing which extends approxiamtely parallel to the ski, wherein said bearing has said locking surface on a further leg thereof which extends approximately vertically, said locking surface having a nose extending transversely of the ski, and wherein, when said sole holder is in its downhill skiing position, an end of said locking member is disposed under said nose of said locking surface.

7. The binding according to claim 1, including a further jaw which is spaced from said first-mentioned jaw and includes down-holding means which can engage the sole of the ski boot; wherein said further jaw includes a flexible bar having one end fixedly supported with respect to the ski and having said down-holding means supported at the opposite end thereof; and wherein said sensor means includes a force sensor provided on said flexible bar.

8. The binding according to claim 7, wherein said flexible bar has approximately vertically extending side surfaces, wherein said force sensor is a resistance strain sensor, and wherein a respective said resistance strain sensor is provided on each said side surface of said flexible bar and is connected by electric wires to said calculator means.

9. The binding according to claim 1, including a further jaw which is spaced from said first-mentioned jaw, said further jaw including an arm which is supported on a stationary first member for pivotal movement about a substantially vertical axis and which has down-holding means thereon at a location spaced from said vertical axis which can engage the sole of the ski boot, and including a stationary second member which is spaced from said first member; and wherein said sensor means includes a force sensor which is provided on said second member, is engaged by said arm, and is connected by electric wires to said calculator means.

* * * * *